United States Patent [19]

Kuno

[11] 4,424,117

[45] Jan. 3, 1984

[54] HYDROSTRIPPING PROCESS OF CRUDE OIL

[76] Inventor: Masaya Kuno, 7–13, Isuruma 1-chome Machida, Tokyo, Japan

[21] Appl. No.: 376,217

[22] Filed: May 7, 1982

[30] Foreign Application Priority Data

Jun. 1, 1981 [JP] Japan ..... 56-082496

[51] Int. Cl.[3] ..... C10G 65/04; B01D 3/34

[52] U.S. Cl. ..... 208/211; 208/92; 208/264; 208/356; 208/362

[58] Field of Search ..... 208/211, 264, 92, 356, 208/362

[56] References Cited

U.S. PATENT DOCUMENTS 3,124,526 3/1964 Butler et al. ..... 208/264
3,637,485 1/1972 Salka ..... 208/211

FOREIGN PATENT DOCUMENTS 54-20007 2/1979 Japan ..... 208/362
111933 12/1917 United Kingdom ..... 208/362

OTHER PUBLICATIONS

Kuno M., "$H_2$ Links Crude Unit and Treater", Hydrocarbon Processing, Sep. 1981, pp. 124–128.

*Primary Examiner*—Delbert E. Gantz
*Assistant Examiner*—O. Chaudhuri
*Attorney, Agent, or Firm*—Wenderoth, Lind & Ponack

[57] ABSTRACT

Hydrogen partial pressure in the distilled vapor phase in a stripper is maintained sufficienty to allow a smooth distillation processing whereby an efficient crude oil stripping is performed. The distillate overhead thus produced is maintained at a temperature high enough for direct feeding to a subsequent hydrotreating process by means of a reflux cooler installed at the top of the stripper.

2 Claims, 2 Drawing Figures

HYDROSTRIPPING PROCESS OF CRUDE OIL

BACKGROUND AND BRIEF SUMMARY OF THE INVENTION

This invention relates to a refinery system, more particularly, it is concerned with a hydroskimming refinery system.

It is a recent tendency that almost all distillates have been desulfurized under high hydrogen partial pressure, to extend the life of the catalysts for as long as possible and to prevent any worsening of environmental contamination. Therefore, the hydrogen requirements and the adoption of hydroskimming refinery system have increased every year.

The situation mentioned above and a concern for energy conservation at refineries are creating the motives for making further research and developments for new hydrogen processing and crude oil separation techniques.

This tendency may be accelerated by the use of sour crude as feedstock.

There are a couple of newly developed processes which may be classified as prior art.

One is concerned with a crude separation system by which crude oil mixed with hydrogen at high temperature and high pressure is separated into two fractions such as distillate overhead and residue. The separated overhead is sent to a subsequent process designed for an overhead distillate hydrodesulfurization reaction, while the residue is pumped to an operating pressure necessary for residue hydrodesulfurization before being mixed with a large excess of hydrogen and introduced into a heater.

The other is also concerned with a crude separation process by which crude oil is distilled with hydrogen rich gas at a temperature between 350° C. and 500° C. and at a pressure between 10 kg/cm$^2$ G and 100 kg/cm$^2$ G, whereby the crude oil is separated into various fractions ranging from light naphtha to VGO equivalents.

However, when the stripped lighter fraction such as distillate overhead is introduced to a subsequent hydrodesulfurization process, it is necessary for the lighter fraction to be reheated to the temperature required for an efficient processing before its introduction thereto by means of additional devices such as a start-up heater and heat exchangers, which usually brings further complexities to the operation of the system.

The object of this invention is to provide a most efficient and economical hydrodesulfurization process of crude oil by the combination of hydrogen stripping and hydrotreating system wherein disengaged distillate overhead may be introduced directly to a subsequent device such as a hydro-desulfurization reactor preferably without any heat adjustment process being employed after the overhead is withdrawn from the hydrogen stripping device to be fed to the subsequent hydrotreating process. The combination of hydrogen stripping and hydrotreating system as heretofore explained is hereinafter called hydrostripping process.

Another object of this invention is to provide an economical process by obtaining the temperature, the pressure and the ratio of hydrogen to oil available for an efficient operation of the hydrostripping system.

An outline of the process of this invention will be explained hereunder.

Crude oil after being desalted and filtered is pumped to a Pressure between 50 kg/cm$^2$ G and 70 kg/cm$^2$ G and is mixed with hydrogen rich gas in an amount ranging from 50 Nm$^3$ and 200 Nm$^3$ (as pure $H_2$) per m$^3$ of crude. Crude mixed with hydrogen is introduced to a crude oil heater wherein the mixture is heated to a temperature between 360° C. and 430° C. before sending to a stripper at the bottom of which is charged continuously an additional hydrogen rich gas which is heated to a temperature between 350° C. and 550° C. in an amount ranging from 50 Nm$^3$ to 200 Nm$^3$ (as pure $H_2$) per m$^3$ of crude. In the stripper the mixture of crude and hydrogen rich gas thus produced is distilled and disengaged into two fractions, gas oil and lighter fractions and a heavier residue fraction.

A reflux cooler installed at the stripper top helps separate crude oil into two fractions as explained heretofore and also prevents the contamination of heavier residue from carrying over to a subsequent gas oil and lighter hydrodesulfurization process and at the same time maintains the temperature of distillate overhead higher than that of start run condition of the subsequent hydrodesulfurizing reaction, said temperature being maintained, for example, between 340° C. and 385° C.

Naturally the gas oil and lighter fraction produced in the stripper can be fed directly to the subsequent process for desulfurization without any temperature adjustment process being employed therebetween, thereby a continuous and efficient operation of the process is achieved, while the heavier residue can be fed to a buffer tank and on to another hydrodesulfurization process etc., as in conventional flow patterns.

The advantage of this invention which is the combination of a crude oil distillation and a hydrotreating process for the distillate overhead is obtained by an effective use of the high temperature latent heat generated at the top of the stripper and the integration of the heat and energy for the distillation and hydrotreating units without consuming steam as used in a conventional topping unit or vacuum unit.

Another feature of this invention is to obtain distillate overhead whose temperature is maintained higher than that of the run condition of a subsequent hydrodesulfurization reaction under high pressure ranging from 40 kg/cm$^2$ G to 60 kg/cm$^2$ G, middle distillates and lighter fractions obtained thereby boiling in the IBP-525° C. range, preferably in the IBP-340° C. range.

The advantage and feature stated above have never been accomplished by any prior art.

The refiners recently attempted deep distillation in the topping unit to gain more lighter fractions from crude oil, moved deeper into the barrel and installed separate hydrotreating plants of higher pressure design to take the sulfur out of vacuum gas oils in order to improve the catalytic cracking plant performance or to hydrocrack directly to gasoline and jet fuels. The deep distillation of this type can also be performed by the hydrostripping process of this invention.

It should be noted, however, that the purpose of this invention is not to provide a method of cracking crude oil even if cracking may slightly occur at the said temperature range.

DETAILED DESCRIPTION

The process of this invention will be described hereinafter with specific reference to the drawings.

Figure 1:
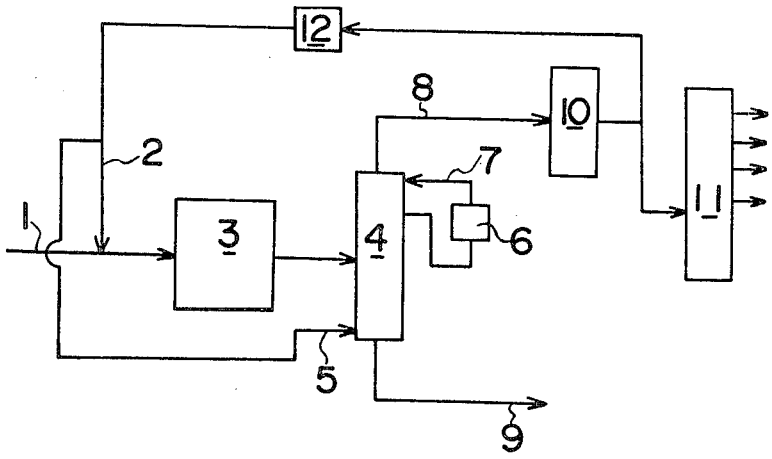
FIG. 1 indicates a schematic flow chart for the practice of the present invention.

Referring to FIG. 1, crude oil from line (1) is elevated to a pressure, for example 60 kg $cm^2$ G, after being desalted and filtered and is mixed with a large excess of hydrogen supplied from line (2) by means of a recycle compressor (12) in an amount 106 $Nm^3$ (as pure $H_2$) per $m^3$ of crude oil. The mixture is then introduced into a crude oil heater (3) and after being heated to a temperature of 388° C. therethrough is fed to a crude oil stripper (4) equipped with 9 trays wherein a high temperature and a high pressure are maintained.

Additional hydrogen for stripping in an amount 106 $Nm^3$ (as pure $H_2$) per $m^3$ of crude is charged at the bottom of said stripper (4) through line (5), wherein the mixture of crude and the hydrogen thus processed is separated and distilled into two fractions.

A distillate overhead, one of the fractions, after being cooled by a reflux (7) generated by and circulated through a reflux cooler (6) installed at the top of the stripper (4), is fed directly to a subsequent hydrodesulfurization reactor (10) for Processing through line (8) and then introduced to a fractionator (11).

The reflux (7) generated by and circulated through the reflux cooler (6) installed at the top of the stripper (4) also helps disengage the crude into overhead and residue.

The bottom residue collected at the stripper bottom may be sent to the hydrodesulfurization unit and/or hydrocracker unit through a buffer-tank (not shown) by line (9).

Figure 2:
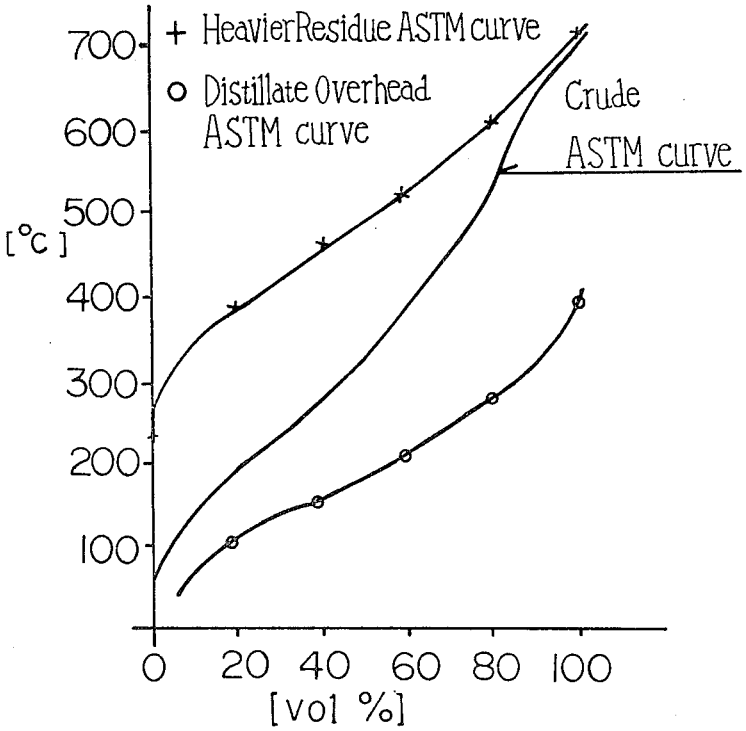
FIG. 2 shows graphically the yield of distillate overhead gas oil and residue obtainable by the process of the present invention.

The yield shown in FIG. 2 is obtainable when Khafji crude (28.4° API and 2.85 wt%S) is used as a charged stock in the following manner.

Khafji crude from line (1) is pumped to a pressure of about 60 kg/$cm^2$ G and after being desalted and mixed with hydrogen rich gas composed of 80 vol% $H_2$, 15 vol% $C_1$ and 5 vol% $C_2$ in an amount of 106 $Nm^3$ (as pure $H_2$) per $m^3$ of crude, and after being heated to a temperature of 388° C. through the heater (3), is sent to the crude oil stripper (4)

Additional hydrogen rich gas of the same composition and ratio to crude as mixed with Khafji crude is charged at the bottom of stripper (4) through line (5), wherein the mixture of crude and hydrogen thus prepared is separated into two fractions, as shown in FIG. 2, at the pressure of 44 kg/$cm^2$ G and at the temperature of 343° C. measured at the top of the stripper (4). Hydrogen partial pressure in distilled vapor phase is about 30 kg/$cm^2$ at 343° C. which is high enough for desulfurization reaction.

The obtained distillate overhead supplied to the hydrodesulfurization reaction (10) is boiling in the IBP-430° C. range and more than 90% of the overhead may be desulfurized at the hydrodesulpurization reactor (10).

Catalysts available for the process of this invention may be composed of cobalt, molybdenum or the like deposited on a support such as aluminum, silicate or the like.

What I claim is:

1. A hydrostripping process which is the combination of crude oil distillation and hydrotreating of a distillate overhead, wherein crude oil mixed with a large amount of hydrogen is distilled under high temperature and pressure and separated into a distillate overhead to be hydrotreated and into a heavy residue, said distillate to be subsequently hydrotreated in a hydrosulfurization reactor, said process comprising:

a. supplying crude oil mixed with hydrogen rich gas into a crude oil heater and then into a crude oil stripper, b. supplying additional hydrogen rich gas at the bottom of said crude oil stripper, c. distilling and separating the resultant mixture of crude oil and hydrogen rich gas into distillate overhead and heavy residue in said stripper under high temperatures and pressures, d. circulating a reflux through a reflux cooler located at the top of the stripper, said reflux helping to separate the crude oil into distillate overhead and residue at the bottom of said stripper, thereby preventing the contamination of the heavier residue from carrying over to a subsequent hydrodesulfurization reactor and maintaining the temperature of said distillate overhead higher than that of the starting temperature conditions of the subsequent hydrodesulfurization reaction, whereby the relatively heavy residue free distillate overhead is directly supplied to the hydrodesulfurization reactor.

2. A process in accordance with claim 1, wherein crude oil mixed with hydrogen rich gas in an amount ranging from 50 $Nm^3$ to 200$Nm^3$, as pure $H_2$, per $m^3$ of crude oil is introduced into the crude oil heater whereby the mixture of hydrogen rich gas and crude oil is heated to temperatures of 360° C.–430° C. and then into the stripper, wherein additional hydrogen rich gas in an amount ranging from 50 $Nm^3$ to 200 $Nm^3$, as pure $H_2$, per $m^3$ of crude oil is charged at the bottom of said stripper after said hydrogen rich gas has been previously heated to a temperature between 350° C. and 550° C.; the resultant mixture of crude oil and hydrogen rich gas being distilled in said stripper and separated into said distillate overhead and a heavier residue under a pressure between 40 kg/$cm^2$ G and 60 kg/$cm^2$ G, and wherein the distillate is directed from the top of the crude oil stripper to a hydrodesulfurization reactor.

* * * * *